United States Patent [19]

Weil

[11] 3,998,967

[45] Dec. 21, 1976

[54] METHOD OF INHIBITING THE GROWTH OF BACTERIA AND FUNGI WITH HIGHER ALIPHATIC AMINE SALTS OF NITRILOTRIACETIC ACID

[75] Inventor: Edward D. Weil, Yonkers, N.Y.

[73] Assignee: Stauffer Chemical Company, Westport, Conn.

[22] Filed: July 14, 1975

[21] Appl. No.: 595,826

Related U.S. Application Data

[60] Continuation of Ser. No. 423,965, Dec. 12, 1973, abandoned, which is a continuation of Ser. No. 202,001, Nov. 24, 1971, abandoned, which is a division of Ser. No. 830,873, June 5, 1969, abandoned.

[52] U.S. Cl. ..... 424/316; 71/113; 106/273 N; 252/77; 252/54 C; 260/45.85 N; 260/501.11; 260/897 A; 526/5

[51] Int. Cl.[2] ..... A01N 9/20

[58] Field of Search ..... 424/316; 252/546; 260/501.11

[56] References Cited

FOREIGN PATENTS OR APPLICATIONS 808,874 2/1959 United Kingdom

*Primary Examiner*—Albert T. Meyers
*Assistant Examiner*—Allen J. Robinson
*Attorney, Agent, or Firm*—Ellen P. Trevors; Daniel S. Ortiz

[57] ABSTRACT

A method for inhibiting the growth of bacteria and fungi by exposing same to an effective amount of a salt of nitrilotriacetic acid with a higher aliphatic amine containing from about 8 to about 60 carbon atoms. The nitrilotriacetic acid is reacted with an amine containing alkyl, alkenyl and/or cycloalkyl radicals to provide the desired salt.

4 Claims, No Drawings

METHOD OF INHIBITING THE GROWTH OF BACTERIA AND FUNGI WITH HIGHER ALIPHATIC AMINE SALTS OF NITRILOTRIACETIC ACID

CROSS-REFERENCES TO RELATED APPLICATIONS

This application is a continuation of application U.S. Ser. No. 423,965, filed Dec. 12, 1973, now abandoned, which was a continuation of application U.S. Ser. No. 202,001, filed Nov. 24, 1971, now abandoned, which in turn was a divisional of application U.S. Ser. No. 830,873 filed June 5, 1969, now abandoned.

BACKGROUND OF THE INVENTION

The nitrilotriacetic compounds, such as nitrilotriacetonitrile, nitrilotriacetic acid and sodium nitrilotriacetate have long been known in the art. The nitrilotriacetonitrile can be manufactured by reacting ammonia and formaldehyde together in stoichiometric portions and thereafter in the presence of sulfuric acid, hydrogen cyanide and additional formaldehyde are reacted together to form nitrilotriacetonitrile. The sodium salt of the corresponding tricarboxcyclic acid can be formed by reacting sodium hydroxide with the nitrilotriacetonitrile to form sodium nitrilotriacetate. The acid can be formed by reacting the nitrilotriacetonitrile with an acid to form nitrilotriacetic acid. These compounds have wide utility as chelating agents. However, the utility of the prior art salts has been limited to aqueous solutions. Although amine salts of nitrilotriacetic acid have been referred to, these known salts have been of such a nature as to be substantially insoluble in nonpolar media and in alcohols.

BRIEF DESCRIPTION OF THE INVENTION

It has been discovered that the salts of nitrilotriacetic acid with aliphatic amines of 8 or more carbon atoms have substantial solubility in, or miscibility with, organic substances of substantially non-polar nature, and in alcohols. These salts exhibit the combined properties of chelating agents, surface active agents, antioxidants and antimicrobiological agents. Thus, because of this solubility, the salts of the present invention can be readily combined with oils, polyolefins, fuels, solvents, cosmetics and the like to enhance the properties thereof.

DETAILED DESCRIPTION OF THE INVENTION

In the practice of the present invention, the salts of the present invention are manufactured by merely admixing the nitrilotriacetic acid and the appropriate amine, whereupon neutralization takes place with salt formation. Because of the limited solubility of the nitrilotriacetic acid, it is preferred to speed up the reaction by heating. The amount of heat added will range just above ambient temperature up to about 200° C. No solvent is required, but the reaction can be further speeded up in some instances by employing a solvent, such as an aromatic hydrocarbon or chlorohydrocarbon, water, an alcohol, dimethylformamide, dimethyl sulfoxide, N-methyl-pyrrolidone, or acetone.

The amine reactable with nitrilotriacetic acid are those higher aliphatic amines, such amines containing alkyl, alkenyl, cycloalkyl, cycloalkenyl, and such radicals containing non-interfering subtituents such as alkoxy. Suitable amines include n-octylamine, isooctylamine, 2-ethylhexylamine, tertiary-octylamine, dibutylamine, tri-n-propylamine, triallylamine, dicyclohexylamine, N-ethylcyclohexylamine, nonylamine, decylamine, dodecylamine, hexyldimethylamine, tributylamine, dimethylcocoamine, dimethylstearylamine, eicosylamine, methyldistearylamine, tristearylamine, mixed $C_{18}$ – $C_{22}$ tertiary-alkylamine, trieicosylamine and mixtures thereof. As a practical upper limit, about 60 carbon atoms may be stated since higher amines are not generally available. The lower limit of the number of carbon atoms in the higher aliphatic amine is 8.

The products of the present invention are generally waxy solids or viscous syrups, usually colorless or straw colored, with negligible odor.

The solubility of the higher aliphatic amine salts of nitrilotriacetic acid in organic solvents varies from moderate to complete miscibility, but in all cases is of a useful degree to permit the compounds of the present invention to be used as effective preservatives or oils, fuels, solvents, greases, waxes, resins, ointments, cosmetic formulations, paints, inks, and plastics against oxidative deterioration especially where such deterioration is catalyzed by metallic or acidic impurities. As an example of such situations are the deterioration of gasoline or jet fuel from storage especially when contaminated by traces of copper, and the deterioration of polyolefin wire coatings on copper wire. Other examples include the metal catalyzed oxidative deterioration of perchloroethylene, trichloroethylene, methylene chloride, or methylchloroform in dry cleaning or metal degreasing usage, and the rancidification of cold creams. Since the compounds of this invention also exhibit antimicrobiological properties, they are effective in preventing bacterial or fungicide-caused deterioration when applied to the habitat in an amount between about 1 ppm to 5% by weight. Additionally, the compounds of this invention are effective plant growth regulators when used in an amount ranging between about 1 and 20 lbs. per acre. Also, these compounds are excellent emulsifiers for bitumen or asphalt compositions.

The solubility of the products of the present invention in alcohols is of a practical value in alcohol-based cosmetic formulations, alcohol-based antifreezes, and the like. The benefits of the metal-chelating agent are needed, for example, for stabilization and discoloration, but where the prior art inorganic solvents of the nitrilotriacetic acid have not been useful because of their limited solubility in such alcoholic media.

EXAMPLE 1

A mixture of 68.4 grams of a commercial tertiary amine having 2 N-methyl groups and 1 N-alkyl of chain length from $C_8$ to $C_{18}$ derived from coconut fatty acid and sold under the trade name of Armeen DMCD and 19.1 grams of nitrilotriacetic acid were heated and mixed at 100° C for 2 days until the mixture was homogeneous and completely benzene-soluble. The salt structure was shown to be present and the free carboxyl group absent by infra-red bands present at 6.1 to 6.2 microns and absent at 5.8 microns.

EXAMPLE 2

A 2% aqueous solution of the product of Example 1 is capable of emulsifying a mineral oil or asphalt. Also, the 2% aqueous solution rapidly wetted cotton and paper in comparison to distilled water. The sodium salt of nitrilotriacetic acid did not exhibit these surfactant properties.

EXAMPLE 3

The product of Example 1 was applied at 10 lbs./acre post-emergence, complete kill was observed on crab grass and mustard without significant injury to beans.

EXAMPLE 4

The product of Example 1 was introduced into cultures of *Aspergillus niger*, Penicillium and *Escherichia coli* at the rate of 0.01% and prevented further growth of these organisms.

EXAMPLE 5

A similar degree of antimicrobiological activity is observed with the following salts, which are made in a manner similar to that described in Example 1:

- tris-(2-ethylhexylammonium)salt of nitrilotriacetic acid
- bis (trioctylammonium) salt of nitrilotriacetic acid
- bis (diisobutylammonium) salt of nitrilotriacetic acid
- mono (stearyldimethylammonium) salt of nitrilotriacetic acid
- mono (dicyclohexylammonium) salt of nitrilotriacetic acid
- mono ($C_{12}$ - $C_{14}$ tertiary-alkylammonium) salt of nitrilotriacetic acid
- di (tertiary-octylammonium) salt of nitrilotriacetic acid

EXAMPLE 6

A mixture of 100 parts of polyethylene, 0.2 parts of 4,4-thiobis (6-tert-butyl-m-cresol), and 0.5 parts of the product of Example 1 is made by mill blending. When applied as a coating by a conventional extrusion process on copper wire, th formulation is found to remain crackfree and flexible in ordinary outdoor service for substantially longer than a similar wire coating made without the product of Example 1.

Similar results are obtained where the polyethylene in the above formulation replaced by polypropylene, a solid polypropylene-polyisobutylene blend, ethylene-propylene copolymer, or by poly-1-butene.

EXAMPLE 7

A mixture of 19 g (0.1 mole) of nitrilotriacetic acid and 18.5 g (0.2 mole) of dodecylamine in 200 cc of water was heated and stirred until a clear solution was obtained. On evaporation on the steam bath, the bis (dodecylammonium) salt of nitrilotriacetic acid was obtained as a waxy solid, m.p. > 100°, soluble in water, alcohol, and trichloroethylene, and moderately soluble in benzene.

A 2% solution of this compound in water emulsified aromatic solvents readily. A 4% solution of this compound in trichloroethylene afforded a water-in-oil emulsion when water was added.

EXAMPLE 8

Three tenths mols of triallylamine and one tenth mole of nitrilotriacetic acid were heated together in 200 ml. of isopropanol until most of the solid acid had dissolved, and the clear supernatant solution decanted and evaporated to 100° under 15-20 mm. pressure to obtain the neutral salt as a viscous oil. The infra-red spectrum of exhibited strong bands at 1670 $cm^{-1}$ (carboxylate salt) and 1640 (c=c), and showed characteristic multiband broad ammonium salt absorption in 3.5 –4.5 micron region.

EXAMPLE 9

94.5 parts of Primene JM-T, a commercial $C_{18}$ –$C_{22}$ tertiary alkylamine, and 19.1 parts of nitrilotriacetic acid were heated together at reflux temperature in 500 parts of benzene for 24 hours. The solvent was then evaporated leaving the salt as a yellowish gum, the infra-red spectrum of which showed carboxylate absorption and carboxyl absorption bands.

EXAMPLE 10

Iron nails were immersed in solution of 0.1, 0.5 and 1% of the tris (dimethylcocoammonium) salt of nitrilotriacetic acid and allowed to stand at room temperature. In one day, a similar iron nail standing in water containing none of the additive was severely corroded, whereas corrosion was negligible or totally absent in the solutions of the test chemical. After 4 days of 0.5 and 1% solutions continued to prevent corrosion.

What is claimed is:

1. A method of inhibiting the growth of bacteria and fungi which comprises; exposing the bacteria and fungi to an effective amount for inhibiting the growth of bacteria and fungi of a salt of nitrilotriacetic acid with an aliphatic amine containing from about 8 to about 60 carbon atoms, said amine consisting essentially of radicals selected from the group consisting of alkyl, alkenyl and cycloalkyl, wherein the cyclic portion of said cycloalkyl contains 6 carbon atoms.

2. The method of claim 1 wherein the amine salt of nitrilotriacetic acid is a salt of nitrilotriacetic acid and an amine selected from the group consisting of n-octylamine, isooctylamine, 2-ethylhexylamine, tertiary octylamine, dibutylamine, tri-n-propylamine, triallylamine, dicyclohexylamine, n-ethylcyclohexylamine, nonylamine, decylamine, dodecylamine, hexyldimethylamine, tributylamine, dimethylcocoamine, dimethylstearylamine, eicosylamine, methyl distearylamine, tristearylamine, mixed $C_{18}$ –$C_{22}$ tertiary-alkylamine and trieicosylamine.

3. The method of claim 1 wherein the amine salt is selected from the group consisting of:

- tris-(2-ethylhexylammonium) salt of nitrilotriacetic acid,
- bis (trioctylammonium) salt of nitrilotriacetic acid,
- bis (diisobutylammonium) salt of nitrilotriacetic acid,
- mono (stearyldimethylammonium)salt of nitrilotriacetic acid,
- mono(dicyclohexylammonium) salt of nitrilotriacetic acid,
- mono ($C_{12}$–$C_{14}$ tertiary-alkylammonium) salt of nitrilotriacetic acid, and
- di (tertiary-octylammonium) salt of nitrilotriacetic acid.

4. The method of claim 1 wherein the amine salt of nitrilotriacetic acid is the salt formed from an amine having two N-methyl groups and one N-alkyl of chain length from $C_{-8}$ to $C_{-18}$ derived from coconut fatty acid.

* * * * *